US010010997B2

(12) United States Patent
Gawase et al.

(10) Patent No.: US 10,010,997 B2
(45) Date of Patent: Jul. 3, 2018

(54) ABRASIVE CLOTH AND POLISHING METHOD

(71) Applicant: TOSHIBA MEMORY CORPORATION, Tokyo (JP)

(72) Inventors: Akifumi Gawase, Mie (JP); Yukiteru Matsui, Aichi (JP); Takahiko Kawasaki, Aichi (JP); Yosuke Otsuka, Mie (JP); Hajime Eda, Kanagawa (JP)

(73) Assignee: Toshiba Memory Corporation, Tokyo (JP)

( * ) Notice: Subject to any disclaimer, the term of this patent is extended or adjusted under 35 U.S.C. 154(b) by 309 days.

(21) Appl. No.: 14/847,535

(22) Filed: Sep. 8, 2015

(65) Prior Publication Data

US 2016/0129548 A1 May 12, 2016

(30) Foreign Application Priority Data

Nov. 11, 2014 (JP) ..... 2014-229052

(51) Int. Cl.
*B24B 37/24* (2012.01)
*B24B 37/04* (2012.01)

(52) U.S. Cl.
CPC ..... *B24B 37/24* (2013.01); *B24B 37/042* (2013.01)

(58) Field of Classification Search
CPC ..... B24B 37/042; B24B 37/24
See application file for complete search history.

(56) References Cited

U.S. PATENT DOCUMENTS 8,575,030 B2 11/2013 Minamihaba et al.
2003/0220061 A1 11/2003 Prasad
2004/0018809 A1* 1/2004 Petroski ..... B24B 37/205 451/537
2004/0072522 A1* 4/2004 Petroski ..... B24B 37/22 451/533
2005/0215177 A1* 9/2005 Prasad ..... B24B 37/24 451/5
2008/0233845 A1* 9/2008 Annen ..... B24D 9/08 451/259

(Continued)

FOREIGN PATENT DOCUMENTS

JP 2003-197586 A * 7/2003 ..... B24B 37/00
JP 2004-243518 9/2004

(Continued)

OTHER PUBLICATIONS

"Engineering ToolBox"—specific heat—water (published material properties).*

(Continued)

*Primary Examiner* — Marc Carlson
(74) *Attorney, Agent, or Firm* — Finnegan, Henderson, Farabow, Garrett & Dunner, L.L.P.

(57) ABSTRACT

In accordance with an embodiment, a polishing method includes supplying slurry to a surface of a polishing layer including a polymer, and bringing a polishing object into contact with the polishing layer to polish the polishing object. The polishing layer has a fibrous first substance mixed therein or contains a second substance. The second substance is higher in specific heat and higher in thermal conductivity than the polymer in such a manner that the second substance is surrounded by the polymer.

16 Claims, 2 Drawing Sheets

(56) References Cited

U.S. PATENT DOCUMENTS

| | | | | |
|---|---|---|---|---|
| 2009/0047871 | A1* | 2/2009 | Muldowney | B24B 37/26 451/37 |
| 2010/0087128 | A1 | 4/2010 | Nakayama et al. | |
| 2011/0171890 | A1 | 7/2011 | Nakayama et al. | |
| 2012/0034846 | A1 | 2/2012 | Minamihaba et al. | |
| 2013/0316621 | A1 | 11/2013 | Maekawa et al. | |
| 2015/0367478 | A1* | 12/2015 | Lefevre | B24B 37/24 451/56 |

FOREIGN PATENT DOCUMENTS

| | | |
|---|---|---|
| JP | 5013447 | 8/2012 |
| JP | 5109409 | 12/2012 |

OTHER PUBLICATIONS

"Engineering ToolBox"—thermal conductivity—wood pulp and water (published material properties).*

* cited by examiner

ABRASIVE CLOTH AND POLISHING METHOD

CROSS-REFERENCE TO RELATED APPLICATIONS

This application is based upon and claims the benefit of priority from the prior Japanese Patent Application No. 2014-229052 filed on Nov. 11, 2014, the entire contents of which are incorporated herein by reference.

FIELD

Embodiments described herein relate generally to an abrasive cloth and a polishing method.

BACKGROUND

In a manufacturing process of a semiconductor device, chemical mechanical polishing (hereinafter referred to as "CMP") is used to flatten, for example, a metallic film or a polycrystalline silicon film on a substrate, or an insulating film buried in a trench.

Next-generation devices of a three-dimensional layer stack type of the 19 nm generation or later are particularly required to ensure high flatness in a CMP process in order to reduce focus errors in an exposure process, which result from miniaturization and the increase in the number of stacked layers.

DETAILED DESCRIPTION

Figure 1:
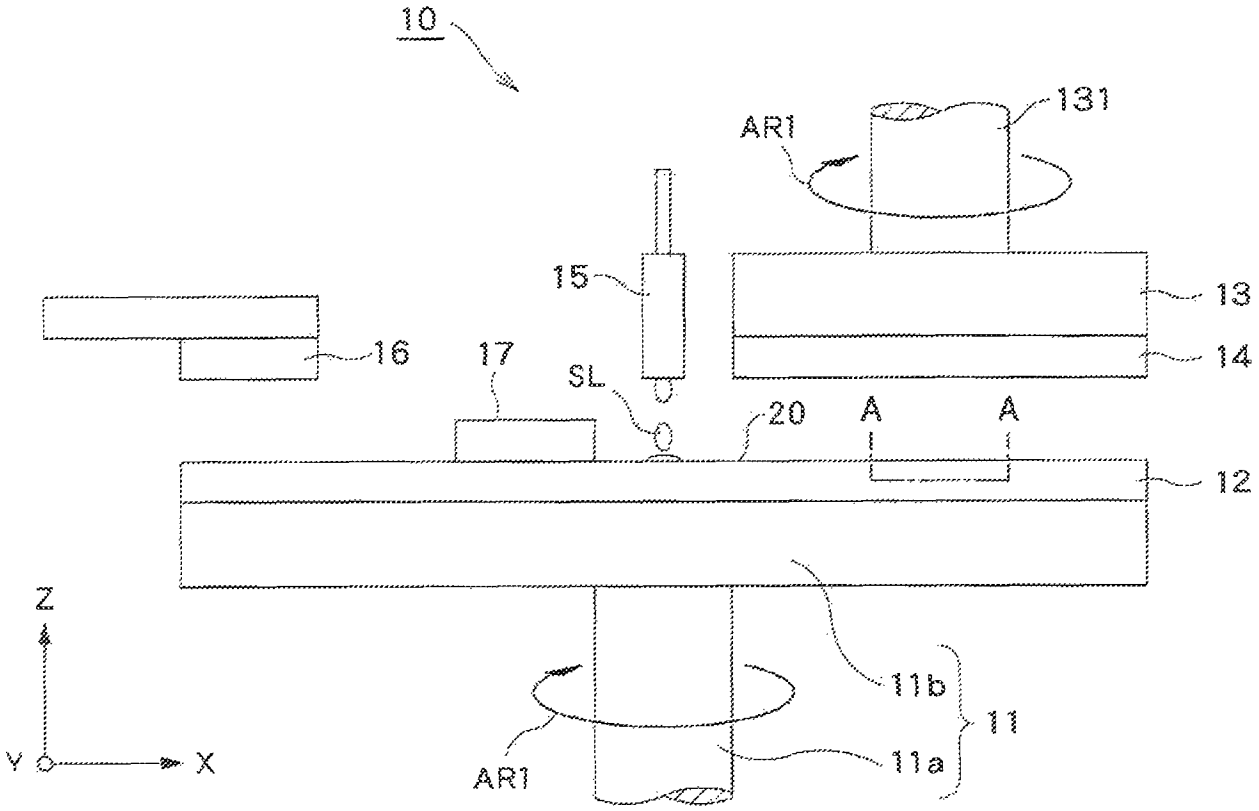
FIG. 1 is an example of a diagram showing a schematic configuration of a CMP apparatus using an abrasive cloth according to one embodiment.

In accordance with an embodiment, a polishing method includes supplying slurry to a surface of a polishing layer including a polymer, and bringing a polishing object into contact with the polishing layer to polish the polishing object. The polishing layer has a fibrous first substance mixed therein or contains a second substance. The second substance is higher in specific heat and higher in thermal conductivity than the polymer in such a manner that the second substance is surrounded by the polymer.

Embodiments will now be explained with reference to the accompanying drawings. Like components are provided with like reference numerals throughout the drawings and repeated descriptions thereof are appropriately omitted. It is to be noted that the accompanying drawings illustrate the invention and assist in the understanding of the illustration and that the shapes, dimensions, and ratios in each of the drawings are different in some parts from those in an actual apparatus.

In the specification of the present application, "stacking" not only includes stacking layers in contact with each other but also includes staking layers with another layer interposed in between. "Being mounted on" not only includes being mounted in direct contact but also includes being mounted with another layer interposed in between. Moreover, terms indicating directions such as the top and the bottom in the description represent relative directions when the surface of a polishing table on which an abrasive cloth is mounted is the top in the description of a CMP apparatus and when the surface of a substrate on which a polishing object is formed is the top in the description of the polishing object. Therefore, the directions may be different from actual directions based on gravitational acceleration directions.

FIG. 1 is an example of a diagram showing a schematic configuration of a CMP apparatus including an abrasive cloth according to one embodiment. A CMP apparatus 10 shown in FIG. 1 includes a seat portion 11, an abrasive cloth 12 according to the present embodiment, a holding portion 13 which holds a polishing object 14, a supply part 15, a surface adjusting part 16, and an abrasive cloth cooling part 17.

The seat portion 11 has a polishing table shaft 11*a*, and a polishing table 11*b* coupled to the polishing table shaft 11*a*. The polishing table shaft 11*a* is connected to an unshown motor, and is rotated and driven by this motor so that the polishing table 11*b* rotates in the direction of, for example, the arrow AR1 via the polishing table shaft 11*a*.

The abrasive cloth 12 is mounted on the polishing table 11*b*. The abrasive cloth 12 is not particularly limited in its structure as long as a polishing layer is formed on the surface thereof with which the polishing object 14 comes into contact. For example, the abrasive cloth 12 may have a layer stack structure having two or more layers. The abrasive cloth 12 according to the present embodiment has a thermal diffusivity of 0.05 $mm^2/s$ or less, preferably 0.04 $mm^2/s$ or less, and has a storage modulus of 200 MPa or more at 20° C. to 60° C. The detailed configuration of the abrasive cloth 12 will be described later in detail.

The holding portion 13 is movable in any of X-, Y-, and Z-directions that constitute three dimensions. For example, when a surface 20 of the abrasive cloth 12 is disposed parallel to an X-Y plane as shown in FIG. 1, the polishing object 14 is moved in the Z-direction while being held so that the polishing object 14 is brought into contact with the surface 20 of the abrasive cloth 12. The holding portion 13 is connected to a motor (not shown) via a shaft 131, and rotates in the direction of, for example, the arrow AR1 via the shaft 131 when the motor is rotated and driven.

The seat portion 11 and the holding portion 13 are preferably rotated and driven together from the perspective of eliminating the unevenness of the polishing amount of the polishing object 14. When these portions are rotated and driven, the rotation direction of the holding portion 13 and the rotation direction of the seat portion 11 are preferably the same as shown in FIG. 1. Although both the polishing table 11*b* and the holding portion 13 rotate in the direction of the arrow AR1 in the case shown in FIG. 1, it should be understood that these portions do not exclusively rotate in this direction, and may rotate in a direction opposite to the arrow AR1.

The supply part 15 is located above the seat portion 11, for example, above the center of a circle when the seat portion 11 is circular cylindrical, and the supply part 15 supplies a slurry SL to the surface 20 of the abrasive cloth 12. The slurry SL includes, for example, a chemical such as an abrasive, and water.

The surface adjusting part 16 has a function to return the surface part of the abrasive cloth 12 which is worn or clogged with abrasive grains in the abrasive due to the polishing of the polishing object 14, to an initial state before the polishing of the polishing object 14.

The abrasive cloth cooling part 17 is located in the vicinity of the surface 20 of the abrasive cloth 12, and cools the surface part of the abrasive cloth 12. The abrasive cloth cooling part 17 includes, for example, a heat exchanger (not shown) which contacts the surface part of the abrasive cloth 12, or a non-contact mechanism (not shown) which supplies an inactive gas (heat-exchange gas) to the surface part of the abrasive cloth 12.

Figure 2:
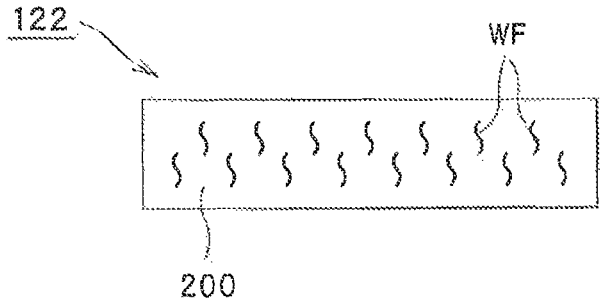
FIG. 2 is an example of a partial sectional view showing a schematic configuration of the abrasive cloth according to Example 1.
Figure 3:
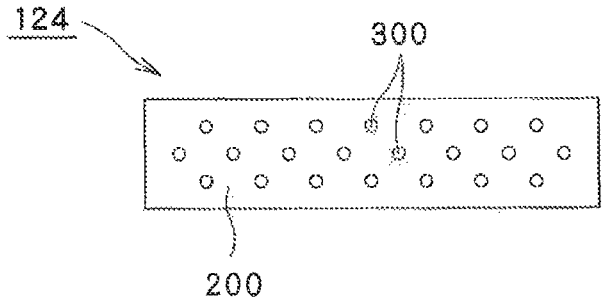
FIG. 3 is an example of a partial sectional view showing a schematic configuration of an abrasive cloth according to Example 2.

FIG. 2 and FIG. 3 are examples of partial sectional views respectively showing Examples 1 and 2 of the abrasive cloth 12, and are, for example, sectional views along a cutting-plane line A-A in FIG. 1.

An abrasive cloth 122 shown in FIG. 2 includes a polishing layer having a polymer 200, and a substance (hereinafter referred to as a "low-thermal-conductivity substance") WF which is mixed in the polymer 200 and which has a low thermal conductivity. Specifically, the thermal conductivity of the low-thermal-conductivity substance WF is preferably 0.15 J/(m·s·K) or less. In the present example, the low-thermal-conductivity substance WF is a fibrous substance such as a wood fiber.

Specific materials of the polymer 200 include polyurethane, polyurea, polyethylene, polypropylene, polyester, polyamide, polyvinyl chloride, an epoxy resin, an ABS resin, an AS resin, butadiene rubber, styrene butadiene rubber, ethylene propylene rubber, silicone rubber, fluoro rubber, and mixtures of the above substances. In the present embodiment, it is preferable to use polyurethane.

According to the abrasive cloth 122 in the present example, the low-thermal-conductivity substance WF is mixed in the polymer 200, so that frictional heat generated between the abrasive cloth 12 and the polishing object 14 during polishing does not easily diffuse into the abrasive cloth 12, and most of the generated frictional heat can be eliminated by the abrasive cloth cooling part 17 before reaching the inside of the abrasive cloth 12. As a result, it is possible to inhibit a temperature rise inside the abrasive cloth 12.

An abrasive cloth 124 shown in FIG. 3 includes a polishing layer having a polymer 200, and a substance 300 which is previously introduced into the gap in the polymer 200 and which is covered in a capsule form so as to be surrounded by the polymer 200 and which is higher in specific heat and thermal conductivity than the polymer 200. The substance 300 is hereinafter referred to as a "high-specific-heat high-thermal-conductivity substance".

Since the thermal conductivity of the high-specific-heat high-thermal-conductivity substance 300 is higher than that of the polymer 200, the frictional heat generated between the abrasive cloth 12 and the polishing object 14 preferentially flows into the material 300. As a result, it is possible to prevent the decrease of the storage modulus of the whole abrasive cloth 12 attributed to a temperature rise. When, for example, polyurethane is selected as the polymer, it is preferable that the specific heat of the high-specific-heat high-thermal-conductivity substance 300 is 1900 J/(kg·K) or more and the thermal conductivity thereof is 0.15 J/(m·s·K) or more. A specific example of the high-specific-heat high-thermal-conductivity substance 300 having such characteristics includes water ($H_2O$).

The low-thermal-conductivity substance WF and the high-specific-heat high-thermal-conductivity substance 300 need to be contained at a position that is deep to some degree from the surface of the abrasive cloth 12, and need to be contained in a place which is shallow but into which the frictional heat comes.

Each of the distribution amounts of the low-thermal-conductivity substance WF (Example 1) and the high-specific-heat high-thermal-conductivity substance 300 (Example 2) is determined in consideration of the balance between the distribution amount and the hardness of the abrasive cloth 12 to be required.

A polishing method using the CMP apparatus 10 shown in FIG. 1 is described as a polishing method according to one embodiment. In the polishing method according to the present embodiment, the slurry SL is supplied from the supply part 15, the polishing object 14 is moved toward the seat portion 11 into contact with the polishing layer (see the reference numeral 122 in FIG. 2 or the reference numeral 124 in FIG. 3) of the abrasive cloth 12, and the polishing object 14 is polished while the surface part of the abrasive cloth 12 is cooled by the abrasive cloth cooling part 17.

When the polishing layer is formed by the polymer 200 alone, the lower limit value of its thermal diffusivity is about 0.06 $mm^2/s$. However, if the low-thermal-conductivity substance WF is mixed in the polymer 200 (Example 1), or if the high-specific-heat high-thermal-conductivity substance 300 higher in specific heat and thermal conductivity than the polymer 200 is previously contained so as to be surrounded by the polymer 200 (Example 2), the thermal diffusivity of the polishing layer can be reduced to 0.04 $mm^2/s$ or less, and the storage modulus at 20° C. to 60° C. can be 200 MPa or more.

At a thermal diffusivity of 0.05 $mm^2/s$ or less, the temperature rise inside the abrasive cloth 12 during polishing can be inhibited. At a storage modulus of 200 MPa or more, sufficient flatness of the surface of the polishing object can be ensured by the effect of the inhibited temperature rise.

Figure 4:
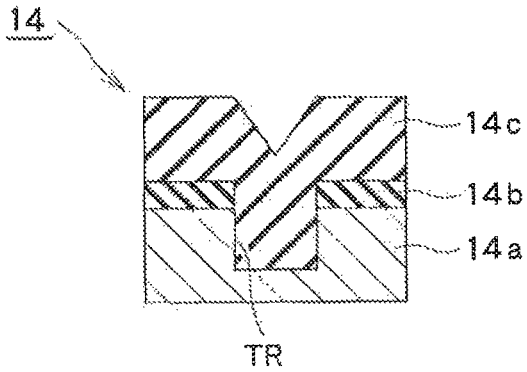
FIG. 4 is a diagram showing an example of a schematic sectional view showing an example of a polishing object as a polishing target for the CMP apparatus in FIG. 1.

FIG. 4 is an example of a schematic sectional view showing an example of the polishing object 14. The polishing object 14 shown in FIG. 4 includes a semiconductor substrate 14*a*, a stopper film 14*b*, and an insulating film 14*c*. The stopper film 14*b* is formed on the semiconductor substrate 14*a*. The insulating film 14*c* is formed on the semiconductor substrate 14*a* so as to fill a trench TR provided in the semiconductor substrate 14*a* and the stopper film 14*b*. The stopper film 14*b* is made of a material having a polishing selection ratio to the insulating film 14*c*. For example, when the insulating film 14*c* is a silicon oxide film, the stopper film 14*b* is a silicon nitride film.

At the time of CMP, the polishing object 14 is turned upside down from the state shown in FIG. 4 and then held by the holding portion 13 so that the insulating film 14*c* faces the seat portion 11.

According to the present embodiment, the abrasive cloth 12 has a low thermal diffusivity of 0.05 $mm^2/s$ or less, so that the frictional heat between the abrasive cloth 12 and the polishing object 14 does not diffuse into the abrasive cloth 12 too much, and is mostly consumed to raise the temperature of the uppermost surface. The abrasive cloth cooling part 17 cools from the surface side of the abrasive cloth 12, and can therefore more effectively cool the abrasive cloth 12 than when the thermal diffusivity of the abrasive cloth 12 is high. As a result, it is possible to maintain a higher storage modulus of the whole abrasive cloth. Consequently, high flatness of the surface of the polishing object 14 can be ensured.

Figure 5:
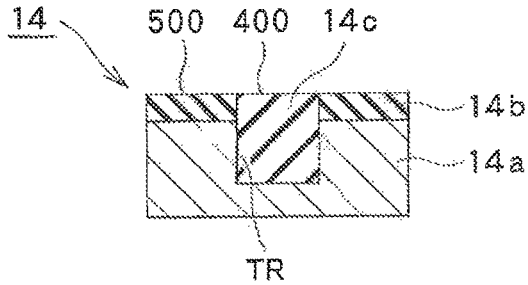
FIG. 5 is an example of a schematic sectional view showing a manufacturing process of a semiconductor device using a polishing method according to one embodiment.

FIG. 5 is a schematic sectional view showing the after-processing state of the polishing object 14 obtained by the polishing method according to the present embodiment. As shown in FIG. 5, a surface 400 of the insulating film 14*c* is flush with a surface 500 of the stopper film 14*b*. Thus, according to the present embodiment, it is possible to obtain high flatness in the processing surface of the polishing object 14.

According to the present embodiment, the thermal diffusivity can be measured by, for example, a laser flash method.

The storage modulus can be measured by, for example, a nonresonant forced vibration method.

If the thermal diffusivity of the abrasive cloth 12 is 0.05 $mm^2/s$ or less, a temperature rise inside the abrasive cloth 12 during polishing can be inhibited. If the storage modulus is 200 MPa or more, sufficient flatness of the surface of the polishing object can be ensured by the effect of the inhibited temperature rise.

The abrasive cloth according to at least one embodiment described above has a thermal diffusivity of 0.05 $mm^2/s$ or less, so that it is possible to inhibit a temperature rise inside the abrasive cloth during polishing. Thus, it is possible to prevent the decrease of the storage modulus of the whole abrasive cloth attributed to a temperature rise. Therefore, it is possible to ensure high flatness in the surface of the polishing object.

According to polishing method in at least one embodiment described above, the slurry is supplied to the surface of the polishing layer of the abrasive cloth having a thermal diffusivity of 0.05 $mm^2/s$ or less, the polishing object is brought into contact with the polishing layer, and the polishing object is polished. Therefore, a temperature rise inside the abrasive cloth during polishing is inhibited, so that the decrease of the storage modulus can be prevented, and high flatness of the surface of the polishing object can be ensured.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An abrasive cloth comprising:

a polishing layer comprising a polymer in which a fibrous substance is mixed, wherein the thermal diffusivity of the polishing layer is 0.05 $mm^2/s$ or less.

2. The abrasive cloth of claim 1, wherein the thermal conductivity of the fibrous substance is 0.15 J/(m·s·K) or more.

3. The abrasive cloth of claim 1, wherein the fibrous substance is a wood fiber.

4. The abrasive cloth of claim 1, wherein the polymer comprises at least one of polyurethane, polyurea, polyethylene, polypropylene, polyester, polyamide, polyvinyl chloride, an epoxy resin, an ABS resin, an AS resin, butadiene rubber, styrene butadiene rubber, ethylene propylene rubber, silicone rubber, and fluoro rubber.

5. An abrasive cloth comprising:

a polishing layer comprising a polymer, wherein a substance which is higher in specific heat and higher in thermal conductivity than the polymer is contained so as to be surrounded by the polymer, and the thermal diffusivity of the polishing layer is 0.05 $mm^2/s$ or less.

6. The abrasive cloth of claim 5, wherein the polymer comprises at least one of polyurethane, polyurea, polyethylene, polypropylene, polyester, polyamide, polyvinyl chloride, an epoxy resin, an ABS resin, an AS resin, butadiene rubber, styrene butadiene rubber, ethylene propylene rubber, silicone rubber, and fluoro rubber.

7. The abrasive cloth of claim 5, wherein the polymer comprises polyurethane, and the specific heat of the substance is 1900 J/(kg·K) or more, and the thermal conductivity of the substance is 0.15 J/(m·s·K) or more.

8. The abrasive cloth of claim 7, wherein the substance is water ($H_2O$).

9. A polishing method comprising:

supplying slurry to a surface of a polishing layer comprising a polymer, and bringing a polishing object into contact with the polishing layer to polish the polishing object, wherein the polishing layer comprises a fibrous first substance mixed therein or contains a second substance which is higher in specific heat and higher in thermal conductivity than the polymer in such a manner that the second substance is surrounded by the polymer, wherein the thermal diffusivity of the polishing layer is 0.05 $mm^2/s$ or less, and the polishing object is polished while the surface of the polishing layer is cooled by a cooling part.

10. The method of claim 9, wherein the thermal conductivity of the fibrous substance is 0.15 J/(m·s·K) or more.

11. The method of claim 9, wherein the fibrous first substance is a wood fiber.

12. The method of claim 9, wherein the polymer comprises polyurethane, and the specific heat of the second substance is 1900 J/(kg·K) or more, and the thermal conductivity of the second substance is 0.15 J/(m·s·K) or more.

13. The method of claim 9, wherein the second substance is water ($H_2O$).

14. The method of claim 9, wherein the polymer comprises at least one of polyurethane, polyurea, polyethylene, polypropylene, polyester, polyamide, polyvinyl chloride, an epoxy resin, an ABS resin, an AS resin, butadiene rubber, styrene butadiene rubber, ethylene propylene rubber, silicone rubber, and fluoro rubber.

15. The method of claim 9, wherein the cooling part includes a heat exchanger which contacts to the surface of the polishing layer.

16. The method of claim 9, wherein the cooling part includes a non-contact mechanism which supplies a gas to the surface of the polishing layer.

* * * * *